US007129452B2

(12) United States Patent
Cho

(10) Patent No.: US 7,129,452 B2
(45) Date of Patent: Oct. 31, 2006

(54) WALL-MOUNTED MICROWAVE OVEN

(75) Inventor: Sung Wook Cho, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 60 days.

(21) Appl. No.: 10/917,447

(22) Filed: Aug. 13, 2004

(65) Prior Publication Data

US 2005/0173427 A1 Aug. 11, 2005

(30) Foreign Application Priority Data

Jan. 14, 2004 (KR) ..... 10-2004-0002517

(51) Int. Cl.
*H05B 6/80* (2006.01)

(52) U.S. Cl. ..... 219/756; 219/757; 219/758; 126/273 A; 126/299 D

(58) Field of Classification Search ..... 219/756, 219/702, 762, 763, 739, 751, 758, 757; 126/21 A, 126/273 A, 299 D, 37 B, 275 E, 198, 213, 126/339; 248/282.1, 415
See application file for complete search history.

(56) References Cited

U.S. PATENT DOCUMENTS 292,463 A * 1/1884 Bassett ..... 33/197
4,453,690 A * 6/1984 Takeuji ..... 248/309.1
4,635,615 A * 1/1987 Itoh et al. ..... 126/273 A
4,796,850 A * 1/1989 Aramaki ..... 248/674
6,369,372 B1 * 4/2002 Kim ..... 219/756

FOREIGN PATENT DOCUMENTS

KR 1998-030344 8/1998

* cited by examiner

*Primary Examiner*—Quang Van
(74) *Attorney, Agent, or Firm*—Staas & Halsey LLP

(57) ABSTRACT

A wall-mounted microwave oven including a fixing member having an improved structure for fixing an oven body to a vertical wall. The wall-mounted microwave oven achieves a reduction in manufacturing costs and convenient and simple manufacturing, transporting and installing processes. The wall-mounted microwave oven also includes a sheet adapted to set an accurate mounting position for the fixing member, in which the sheet has a size corresponding to that of the oven body and is made of paper or a similar material. The fixing member is provided with fixing holes. The sheet is provided with fixing position marks indicating fixing positions where screws have to be fastened to the wall through respective fixing holes. The fixing member is also provided with hooks respectively engaged with hook holes formed at a lower end of the oven body.

15 Claims, 3 Drawing Sheets

WALL-MOUNTED MICROWAVE OVEN

CROSS-REFERENCE TO RELATED APPLICATION

This application claims the benefit of Korean Patent Application No. 2004-2517, filed on Jan. 14, 2004, in the Korean Intellectual Property Office, the disclosure of which is incorporated herein by reference.

BACKGROUND OF THE INVENTION

1. Field of the Invention

The present invention relates to a wall-mounted microwave oven, and more particularly, to a wall-mounted microwave oven including a fixing member having an improved structure adapted to fixedly mount an oven body to a wall in a confined space in which the microwave oven is to be installed, thereby achieving a reduction in manufacturing costs and convenient and simple manufacturing and installing processes.

2. Description of the Related Art

Generally, a wall-mounted microwave oven is mounted to a wall in a kitchen space over a complex cooling appliance provided with gas oven ranges. Such a wall-mounted microwave oven not only performs a cooking function using microwaves, similarly to that of general microwave ovens, but also performs a function for externally exhausting fumes, smoke or the smell of food rising from another cooling appliance such as a gas oven or an electric oven arranged beneath the microwave oven during cooking of the food.

In such a wall-mounted microwave oven, microwaves emitted from a magnetron irradiate food to repeatedly change the arrangement of water molecules in the food, thereby causing the food to be cooked by frictional heat of those water molecules. In the wall-mounted microwave oven, an exhaust fan is installed to vent fumes, smoke and food smell rising from a cooking appliance arranged beneath the microwave oven to the exterior during a cooking operation.

The configuration of such a wall-mounted microwave oven will be described in more detail. Similarly to general microwave ovens, this wall-mounted microwave oven includes an oven body defining the appearance of the wall-mounted microwave oven, and a cooking chamber and an electric element chamber partitioned in the interior of the oven body, so as to cook food in the cooking chamber using microwaves. Exhaust passages are formed between facing walls of the oven body and cooking chamber and between facing walls of the oven body and electric element chamber, respectively. An exhaust fan is connected to upper ends of the exhaust passages. With this configuration, the wall-mounted microwave oven can suck fumes, smoke and food smell rising beneath the oven body through the exhaust passages in accordance with an operation of the exhaust fan, and then vent them to the exterior.

The wall-mounted microwave oven also includes a fixing plate for fixedly mounting the oven body to a wall in a kitchen space. Upon mounting the oven body to the wall, the fixing plate is first mounted to the wall at a desired position where the oven body is to be installed. Thereafter, the oven body is coupled, at a lower end thereof, to the fixing plate. The oven body is then fixed, at an upper end thereof, to an outer bottom surface of a sideboard installed on the wall or to a separate bracket fixed to the wall. Thus, the installation of the wall-mounted microwave oven is completed.

However, such a conventional wall-mounted microwave oven has various problems. That is, the fixing plate used in the conventional wall-mounted microwave oven is manufactured to have the same size as that of the oven body, in order to accurately install the oven body at a desired position on the wall, taking into consideration the fact that the oven body is relatively heavy, as disclosed in Korean Utility Model Laid-open Publication No. 1998-030344. For this reason, there is an increase in the manufacturing costs of the fixing plate. Furthermore, there is inconvenience in the processes of manufacturing, transporting, and installing the fixing plate.

SUMMARY OF THE INVENTION

The present invention has been made in view of the above mentioned problems, and an aspect of the invention is to provide a wall-mounted microwave oven including a fixing member having an improved structure adapted to fixedly mount an oven body, thereby achieving a reduction in manufacturing costs and convenient and simple manufacturing, transporting and installing processes.

In accordance with the present invention, this aspect is accomplished by providing a wall-mounted microwave oven having an oven body and a fixing member to fix the oven body to a vertical wall. Further, the fixing member has a mounting section mounted to the vertical wall, and a supporting section to support the oven body, the mounting section having a vertical length less than a height of the oven body.

The wall-mounted microwave oven may further include a sheet to set an accurate mounting position for the fixing member.

The sheet may have a size corresponding to that of the oven body.

The sheet may be made of paper so that it is simply and conveniently attached to the vertical wall.

The mounting section of the fixing member may be provided with fixing holes. The sheet may be provided, at a lower end portion thereof, with fixing position marks to indicate respective accurate positions of the fixing holes to be arranged on the sheet so that the mounting section is mounted to the vertical wall while being horizontally maintained.

The support section of the fixing member may extend horizontally from a lower end of the mounting section in a direction away from the vertical wall while being provided, at a free end thereof, with upwardly-extending hooks respectively engaged with hook holes formed at a lower end of the oven body, such that the support section supports the oven body.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
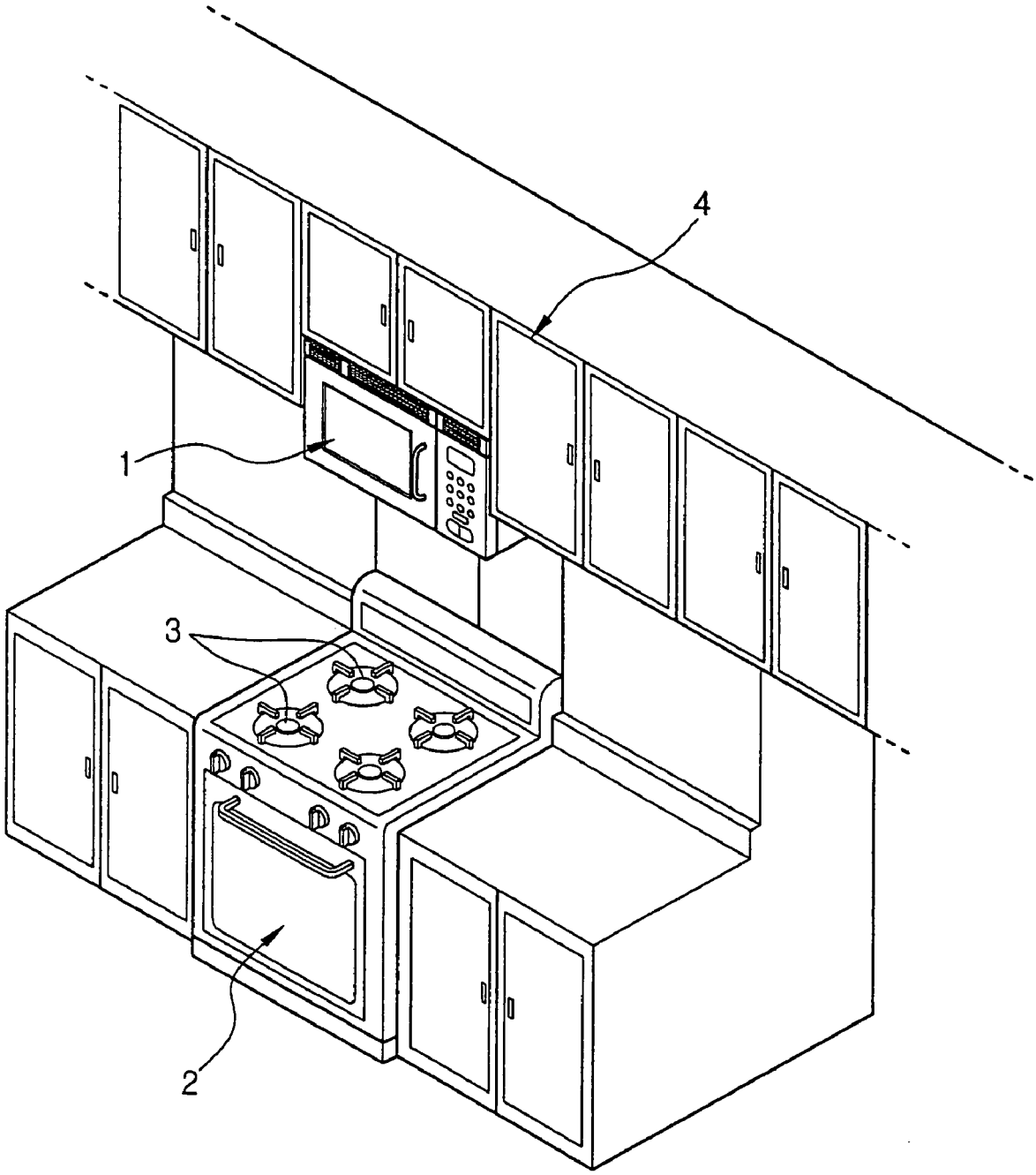
FIG. 1 is a perspective view illustrating a wall-mounted microwave oven according to an embodiment of the present invention, which is mounted to a wall in a kitchen space above a complex cooking appliance provided with several gas oven ranges.

Reference will now be made in detail to embodiments of the present invention, examples of which are illustrated in the accompanying drawings, wherein like reference numerals refer to the like elements throughout. The following embodiments are described below to explain the present invention by referring to the figures.

FIG. 1 is a perspective view illustrating a wall-mounted microwave oven according to an embodiment of the present invention, in which the wall-mounted microwave oven is mounted to a wall in a kitchen space above a complex cooking appliance provided with several gas oven ranges.

As shown in FIG. 1, the wall-mounted microwave oven according to the illustrated embodiment of the present invention, which is designated by reference numeral 1, is typically mounted to a wall in a kitchen space. Also, a complex cooking appliance 2, which is provided with gas oven ranges 3 at the top of the complex cooking appliance 2, is typically arranged beneath the microwave oven 1. Around the wall-mounted microwave oven 1, sideboards 4 are arranged to store various dishes and kitchen utensils.

The wall-mounted microwave oven 1 serves to cook food using microwaves, while sucking fumes, smoke and food smell rising from the complex cooking appliance 2 during a cooking operation thereof, and exhausting them to the exterior. The configuration of the wall-mounted microwave oven 1 will be described hereinafter with reference to FIGS. 2 and 3.

Figure 2:
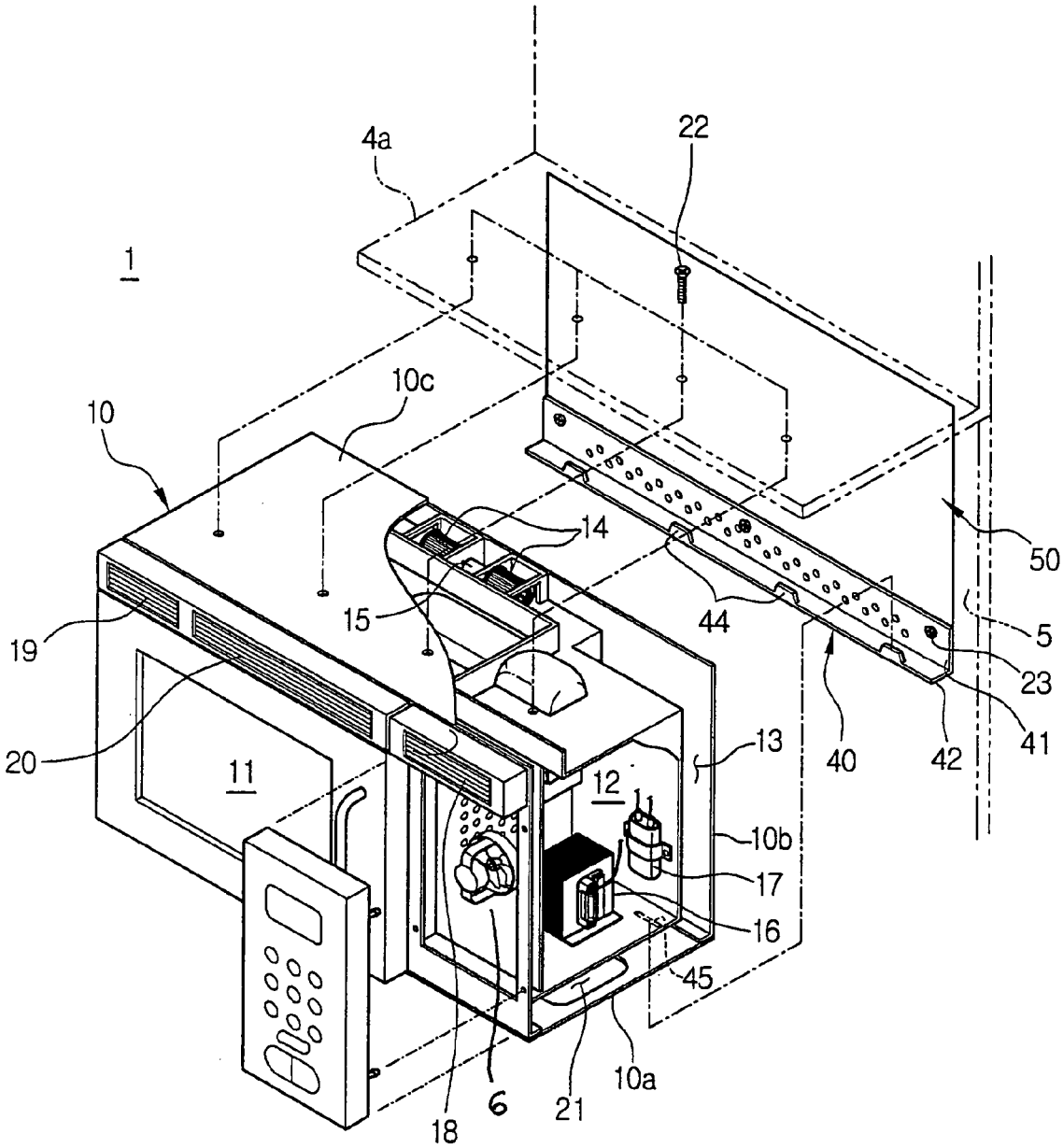
FIG. 2 is a perspective view illustrating a state in which the wall-mounted microwave oven of FIG. 1 has not been mounted to the kitchen wall yet.
Figure 3:
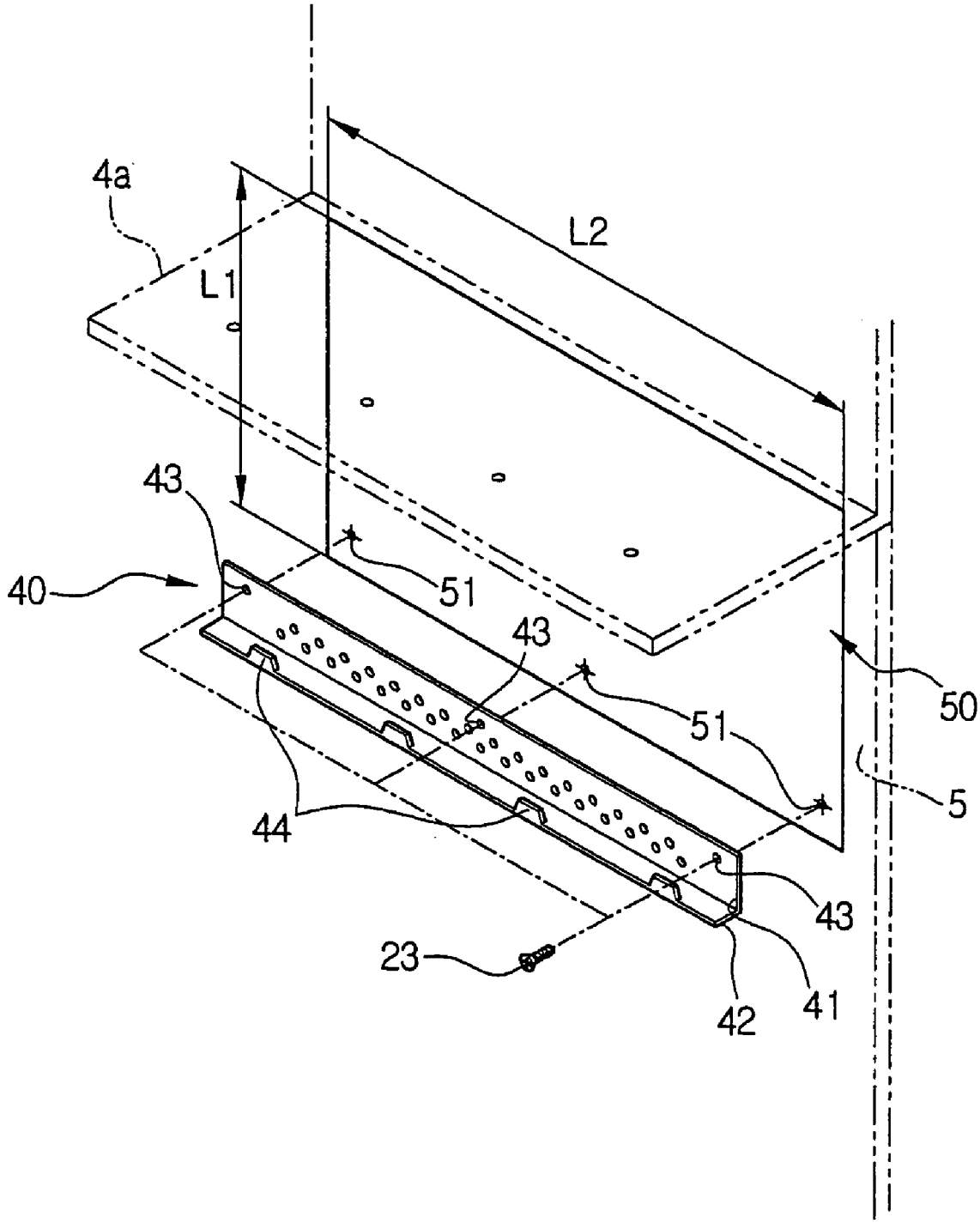
FIG. 3 is a schematic view illustrating a process for attaching a fixing member to a sheet, the fixing member being adapted to fixedly mount an oven body of the wall-mounted microwave oven to the kitchen wall.

FIG. 2 is a perspective view illustrating a state in which the wall-mounted microwave oven of FIG. 1 has not been installed to the kitchen wall 5 yet. FIG. 3 is a schematic view illustrating a process for attaching a fixing member 40 to a sheet 50, the fixing member 40 being adapted to fixedly mount an oven body 10 of the wall-mounted microwave oven 1 to the kitchen wall 5.

As shown in FIG. 2, the wall-mounted microwave oven 1 according to an embodiment of the present invention includes an oven body 10 having a substantially box shape to define the appearance of the wall-mounted microwave oven 1, and a cooking chamber 11 and an electric element chamber 12, which are formed in the interior of the oven body 10 partitioned from each other.

An exhaust passage 13 is formed in the oven body 10 along the bottom, opposite sides and top of the cooking chamber 11 and electric element chamber 12, in order to vent fumes and smoke rising from the complex cooking appliance 2 arranged beneath the oven body 10 to the exterior. A pair of exhaust fans 14 are installed at a rear upper portion of the oven body 10 to externally discharge exhaust gas, fumes, etc., flowing through the exhaust passage 13. A fan motor 15 is also installed at the rear upper portion of the oven body 10 to rotate the exhaust fans 14. The exhaust passage 13 is partitioned from the cooking chamber 11 and electric element chamber 12.

In the electric element chamber 12, electric elements such as a high-voltage transformer 16 and a condenser 17 are arranged. A front air inlet 18 is provided at the oven body 10 in front of the electric element chamber 12 over the electric elements 16 and 17. A front air outlet 19 is also provided at the oven body 10 in front of and over the cooking chamber 11. Air is introduced into the electric element chamber 12 through the front air inlet 18 by a cooling fan 6 installed in the electric element chamber 12, so that the air cools the electric elements arranged in the electric element chamber 12 while circulating within the electric element chamber 12. After circulating within the electric element chamber 12, the air is introduced into the cooking chamber 11 and then discharged from the cooking chamber 11 through the front air outlet 19, along with moisture and food smell existing in the cooking chamber 11. As the wall-mounted microwave oven 1 operates, microwaves irradiate food placed in the cooking chamber 11. Accordingly, the food is cooked by heat caused by the microwaves.

A bottom plate 10*a* is mounted to the bottom of the oven body 10. The bottom plate 10*a* is provided with an exhaust inlet 21. When the fan motor 15 operates to rotate the exhaust fans 14, exhaust containing gas and food smell rising beneath the oven body 10 are sucked into the exhaust passage 13 through the exhaust inlet 21. After flowing through the exhaust passage 13, the sucked exhaust may be vented to the exterior via a duct (not shown) communicating with the exterior. The exhaust passing through the exhaust passage 13 may be again discharged into the kitchen space after being filtered while passing through a discharge grill 20 provided at the oven body 10 in front of and over the cooking chamber 11.

In order to fix the oven body 10 of the wall-mounted microwave oven 1 having the above described configuration to a wall 5 (see FIGS. 2 and 3) in the kitchen space, the fixing member 40 and the sheet 50 are attached to the wall 5 in accordance with an embodiment of the present invention.

In an embodiment of the present invention, the oven body 10 is mounted, at a rear wall 10*b* of the oven body 10, to the fixing member 40, while being mounted, at an upper wall 10*c* thereof, to an outer surface of a bottom wall 4*a* included in a sideboard 4 (see FIG. 1) arranged over the oven body 10, by screws (or bolts) 22.

As shown in FIG. 3, the fixing member 40 has a horizontally elongated structure including a vertical mounting section 41 to be mounted to the wall 5 of the kitchen space, a horizontal supporting section 42 extending forwardly from a lower end of the mounting section 41 by a short distance and having a short width, and hooks 44 upwardly protruding from a front end of the supporting section 42 to support a bottom portion of the oven body 10 corresponding to a lower end of the rear wall 10*b*.

Hook holes 45 are formed through the bottom plate 10*a* of the oven body 10 at positions corresponding to those of the hooks 44 so that they receive the hooks 44, thereby fixing a bottom portion of the oven body 10 corresponding to the lower end of the rear wall 10*b* to the fixing member 40.

The mounting section 41 has a length approximately equal to the horizontal length of the oven body 10. Fixing holes 43 to fix the fixing member 40 to the wall 5 are provided at opposite longitudinal end portions of the mounting section 41 and an intermediate portion thereof, respectively. The length of the mounting section 41 may be slightly more than or less than the horizontal length of the oven body 10.

The fixing member 40 having the above structure is made of a metal material having a high strength, or a similar material. The fixing of the fixing member 40 to the wall 5 is achieved by fastening threaded screws (or bolts) 23 to the wall 5 through the fixing holes 43, respectively.

The sheet 50 sets a reference position for accurately horizontally positioning the fixing member 40 having a very small height, as compared to the height of the oven body 10, thereby accurately horizontally positioning the oven body 10 of the wall-mounted microwave oven 1 at a desired region on the wall 5 without the oven body 10 being slanted. To this end, the sheet 50 has a vertical length L1 approximately equal to the height of the oven body 10, and a longitudinal length L2 approximately equal to or slightly more than the horizontal length of the oven body 10.

The sheet 50 is also provided, at a lower end portion thereof, with fixing position marks 51 horizontally aligned with one another while indicating fixing positions where the fixing holes 43 formed on the mounting section 41 of the fixing member 40 have to be positioned, respectively, thereby allowing the screws 23 to be fastened to the wall 5 through the fixing holes 43 accurately positioned at the wall 5, and thus allowing the fixing member 40 to be horizontally fixed to the wall 5 without being slanted. Although the fixing position marks 51 are provided at opposite end portions of the sheet 50 and an intermediate portion thereof, respectively, in this embodiment of the present invention, the amount of fixing position marks 51 is not limited thereto, and may be increased or decreased, taking into consideration the size and weight of the oven body 10.

For the sake of inexpensive and simple preparation, the sheet 50 is made of paper or a similar material. In this case, the sheet 50 may be simply and conveniently attached to the wall 5 by glue, an adhesive, or an adhesive tape.

Now, the process of mounting the oven body 10 to the wall 5 by use of the fixing member 40 and sheet 50 having the above described structures will be described.

First, the sheet 50, which has a size corresponding to that of the oven body 10, is attached to the wall 5 in the kitchen space by glue or an adhesive tape, in order to set an area where the oven body 10 is to be mounted.

Subsequently, the fixing member 40 is arranged on the sheet 50 such that the fixing holes 43 are positioned at respective fixing position marks 51 of the sheet 50. In this state, the screws 23 are fastened to the wall 5 through respective fixing holes 43. Thus, the fixing member 40 is fixed to the wall 5 of the kitchen space.

Thereafter, the bottom of the oven body 10 is fixed to the fixing member 40 by engaging the hook holes 45 provided at the bottom plate 10*a* of the oven body 10 with respective hooks 44 provided at the front end of the support section 42 of the fixing member 40. The top wall 10*c* of the oven body 10 is then fixed to the bottom wall 4*a* of the sideboard 4 by the screws 22. Thus, the oven body 10 is firmly fixed to the wall 5 in the kitchen space in a horizontal state.

Where there is no sideboard arranged over the oven body 10, the fixing of the oven body 10 at the top thereof may be achieved using a separate bracket mounted to the wall 5 in the kitchen space.

As is apparent from the above description, the wall-mounted microwave oven according to the present invention has a fixing member with an improved structure. The fixing member is conformed to the oven body to a wall in a kitchen space, thereby achieving a reduction in manufacturing costs and convenient and simple manufacturing, transporting and installing processes.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A wall-mounted microwave oven, comprising:

an oven body; and a fixing member which fixes the oven body to a vertical wall, wherein the fixing member comprises a mounting section mounted to the vertical wall, and a supporting section supporting the oven body, the mounting section having a vertical length less than half of a height of the oven body, and the supporting section having a width smaller than the vertical length of the mounting section, and wherein a top of the oven body is fixed to a sideboard mounted to the vertical wall.

2. The wall-mounted microwave oven according to claim 1, further comprising:

a sheet which sets an accurate mounting position for the fixing member.

3. The wall-mounted microwave oven according to claim 2, wherein the sheet has an area corresponding to an area of a surface of the oven body.

4. The wall-mounted microwave oven according to claim 3, wherein:

the mounting section of the fixing member includes a plurality of fixing holes; and the sheet includes a plurality of fixing position marks at a lower portion of the sheet, the fixing position marks corresponding to respective positions of the fixing holes to be arranged on the sheet so that the mounting section is mounted to the vertical wall while being horizontally aligned.

5. The wall-mounted microwave oven according to claim 3, wherein the support section of the fixing member extends horizontally from a lower end of the mounting section in a direction away from the vertical wall and includes a plurality of upwardly-extending hooks at a free end of the support section, the upwardly-extending hooks being respectively engaged with a plurality of hook holes formed at a lower end of the oven body, and wherein the support section supports the oven body.

6. The wall-mounted microwave oven according to claim 2, wherein the sheet includes paper attached to the vertical wall.

7. The wall-mounted microwave oven according to claim 2, wherein:

the mounting section of the fixing member includes a plurality of fixing holes; and the sheet includes a plurality of fixing position marks at a lower portion of the sheet, the fixing position marks corresponding to respective positions of the fixing holes to be arranged on the sheet so that the mounting section is mounted to the vertical wall while being horizontally aligned.

8. The wall-mounted microwave oven according to claim 1, wherein the support section of the fixing member extends horizontally from a lower end of the mounting section in a direction away from the vertical wall and includes a plurality of upwardly-extending hooks at a free end of the support section, the upwardly-extending hooks being respectively engaged with a plurality of hook holes formed at a lower end of the oven body, and wherein the support section supports the oven body.

9. The wall-mounted microwave oven according to claim 1, wherein a horizontal length of the mounting section is substantially equal to a horizontal length of the oven body.

10. The wall-mounted microwave oven according to claim 1, further comprising:

threaded screws which fix the fixing member to the wall, wherein the threaded screws attach the fixing member to the wall through a plurality of fixing holes on the fixing member.

11. A wall-mounted microwave oven, comprising:

an oven body;

a fixing member which fixes the oven body to a vertical wall; and a sheet which sets a mounting position for the fixing member, wherein the fixing member comprises a length approximately equal to a horizontal length of the oven body, a mounting section having a height less than half of that of the oven body, and a supporting section extending forwardly from a lower end of the mounting section, the supporting section comprising a width smaller than the height of the mounting section, and wherein a top of the oven body is fixed to a sideboard mounted to the vertical wall.

12. The wall-mounted microwave oven according to claim 11, wherein the sheet has a vertical length approximately equal to a height of the oven body and a longitudinal length approximately equal to or greater than a horizontal length of the oven body.

13. A fixing member attached to a wall-mounted microwave oven including an oven body having a top fixed to a sideboard mounted to a vertical wall, the fixing member comprising:

a mounting section mounted to the vertical wall; and a supporting section supporting the oven body, the mounting section having a vertical length less than half of a height of the oven body, and the supporting section having a width smaller than the vertical length of the mounting section, wherein the fixing member fixes the oven body to the vertical wall.

14. The fixing member according to claim 13, wherein the fixing member contacts a sheet used for mounting the wall-mounted microwave, wherein the sheet sets a mounting position for the fixing member attached to the oven body, and wherein the sheet has a vertical length approximately equal to a height of the oven body and a longitudinal length approximately equal to or greater than a horizontal length of the oven body.

15. A wall-mounted microwave oven, comprising:

an oven body; and a fixing member which fixes the oven body to a vertical wall, and comprises a mounting section mounted to the vertical wall, and a supporting section supporting the oven body, wherein the mounting section includes a horizontal length greater than or less than a horizontal length of the microwave oven and a height less than that of the oven body and greater than a width of the supporting section.

* * * * *